US010455944B2

(12) United States Patent
Chernin

(10) Patent No.: US 10,455,944 B2
(45) Date of Patent: Oct. 29, 2019

(54) SEAT CUSHION

(71) Applicant: Anatoli Chernin, Richmond Hill (CA)

(72) Inventor: Anatoli Chernin, Richmond Hill (CA)

( * ) Notice: Subject to any disclaimer, the term of this patent is extended or adjusted under 35 U.S.C. 154(b) by 81 days.

(21) Appl. No.: 15/723,870

(22) Filed: Oct. 3, 2017

(65) Prior Publication Data

US 2018/0103763 A1 Apr. 19, 2018

Related U.S. Application Data

(60) Provisional application No. 62/408,847, filed on Oct. 17, 2016.

(51) Int. Cl.

| | |
|---|---|
| ***B68G 5/00*** | (2006.01) |
| ***A47C 16/00*** | (2006.01) |
| ***A47C 7/18*** | (2006.01) |
| ***A47C 7/02*** | (2006.01) |
| ***A47C 7/58*** | (2006.01) |
| ***A61G 5/12*** | (2006.01) |

(52) U.S. Cl.

CPC ..... *A47C 7/185* (2013.01); *A47C 7/029* (2018.08); *A47C 7/58* (2013.01); *A61G 5/124* (2016.11)

(58) Field of Classification Search

CPC ..... A47C 27/144; A47C 27/15; A47C 27/085; A47C 7/021; A47C 7/029

See application file for complete search history.

(56) References Cited

U.S. PATENT DOCUMENTS

| | | | | |
|---|---|---|---|---|
| 4,660,238 | A * | 4/1987 | Jay | A61F 5/01 5/654 |
| 4,726,624 | A * | 2/1988 | Jay | A47C 7/021 297/452.23 |
| 5,018,790 | A * | 5/1991 | Jay | A47C 7/021 297/452.26 |
| 5,191,752 | A * | 3/1993 | Murphy | B68C 1/02 54/44.5 |
| 5,193,237 | A * | 3/1993 | Holdredge | A61G 5/1043 137/625.11 |
| 5,444,881 | A * | 8/1995 | Landi | A61G 5/1043 5/708 |
| 5,445,861 | A * | 8/1995 | Newton | B32B 3/12 428/116 |
| 5,490,299 | A * | 2/1996 | Dinsmoor, III | A47C 7/021 5/654 |
| 5,592,706 | A * | 1/1997 | Pearce | A47C 27/083 5/654 |
| 5,617,595 | A * | 4/1997 | Landi | A61G 5/1043 297/452.41 |
| 5,636,395 | A * | 6/1997 | Serda | A47C 27/085 5/655.5 |
| 5,749,111 | A * | 5/1998 | Pearce | A43B 13/04 428/137 |
| 6,026,527 | A * | 2/2000 | Pearce | A43B 13/04 428/137 |

(Continued)

*Primary Examiner* — Shin H Kim

(74) *Attorney, Agent, or Firm* — Guy Levi; The IP Law Firm of Guy Levi, LLC

(57) ABSTRACT

A seat cushion provided for supporting a sitting person, including a seat portion having an upwardly facing surface and a downwardly facing surface; a plurality of mutually spaced inclined grooves formed in the seat portion; wherein the inclined grooves extend along at least a portion of the distance between the upwardly facing surface and the downwardly facing surface.

19 Claims, 12 Drawing Sheets

(56) References Cited

U.S. PATENT DOCUMENTS 6,842,926 B2 * 1/2005 Kuo ..... A47C 27/085 5/654
6,898,814 B2 * 5/2005 Kawamura ..... A47C 21/046 5/652
7,076,822 B2 * 7/2006 Pearce ..... A43B 13/04 5/654
7,216,388 B2 * 5/2007 Bieganek ..... A61G 5/1043 5/653
7,373,678 B2 * 5/2008 Hetzel ..... A61G 5/1043 5/653
8,109,050 B2 * 2/2012 Ovaert ..... E04F 15/22 52/1
8,245,341 B2 * 8/2012 Oh ..... A47C 27/144 5/722
8,359,689 B2 * 1/2013 Warren ..... A47C 27/15 5/655.9
8,424,137 B1 * 4/2013 Pearce ..... A47C 27/085 5/630
8,434,748 B1 * 5/2013 Pearce ..... B68G 5/00 267/142
8,628,067 B2 * 1/2014 Pearce ..... A47C 27/144 267/142
8,668,977 B2 * 3/2014 Callsen ..... A47C 27/085 428/158
8,932,692 B2 * 1/2015 Pearce ..... A47C 27/056 156/242
9,125,493 B2 * 9/2015 Siekman ..... A47C 7/021
9,603,461 B2 * 3/2017 Pearce ..... A47C 27/10
9,763,522 B2 * 9/2017 Siekman ..... A47C 7/021
10,045,633 B2 * 8/2018 Allman ..... A47C 27/144
D840,724 S * 2/2019 Dowd ..... D6/601
2001/0013146 A1 * 8/2001 Wempe ..... A47C 27/086 5/654
2004/0226098 A1 * 11/2004 Pearce ..... A43B 13/04 5/655.5
2004/0226099 A1 * 11/2004 Pearce ..... A43B 13/04 5/655.5
2005/0223667 A1 * 10/2005 McCann ..... A47C 27/085 52/403.1
2006/0253988 A1 * 11/2006 Pearce ..... A43B 13/04 5/655.5
2014/0304921 A1 * 10/2014 Collins ..... A47C 27/15 5/727
2015/0351557 A1 * 12/2015 Allen ..... A47C 27/144 5/655.5

* cited by examiner

SEAT CUSHION

BACKGROUND

Substantially immobile people (i.e. wheelchair bound users) experience a great need for body supports that minimize development of decubitus ulcers (i.e. bedsores) caused by skin stress, that can occur during long periods of immobility, such as confinements to wheelchairs.

The common approach to addressing this need is usage of stress-absorbing and pressure dispersing materials, such as various gels and foams. Such cushions, of various shapes and sizes, are described in U.S. Pat. Nos. 7,216,388 and 5,444,881, for example.

Known seat cushions do not resolve the appearance of high pressure points along the surface of the cushions at locations varying from one user to another due to personal anatomy.

In other prior art devices, such as described in U.S. Pat. No. 5,191,752, the cushion is a sack filled with gel or another fluid-like substance. While such design provides relatively high shock-absorbency, it does not provide adequate anatomical support, moreover—it is prone to leaks.

Using gel materials themselves face user with many difficulties, for example, heat retention. During continuous periods of contact with user's body, the temperature and moisture in the contact areas between the gel-filled cushion and the user's body also increases. Risen material heat causes user discomfort and increases suffering caused by new and existing injuries, such as bedsores. Heat causes increased growth of bacteria in sored area, thus promoting infections and skin irritations. Another disadvantage is the relatively high weight of the gel materials themselves, while relative fragility.

Well known in the art alternative to use of gel materials is use of foam materials. However, using foam materials proves to be less than optimal as well. After many usage cycles, foam is taking compression set, losing cushion support benefit.

The problem of pressure relief was attempted to be resolved in numerous ways. For example, U.S. Pat. No. 5,193,237 discloses a pneumatic cushion having a number of separate air pockets arranged in a matrix. Reduced airflow and therefore reduced air pressure is periodically provided within the cushion so that each air sack will have reduced pressure for a predetermined period of time. A self-regulating air distribution is provided such that when the occupant shifts his/her weight so as to overcome the air pressure in a sack, the system automatically backflows air into that particular sack thereby cushioning the user. While providing seemingly adequate result, devices such as aforementioned provide expensive to manufacture and maintain solution.

Thus, there is a need to provide an improved anatomical support device that reduces shear forces and pressure on the upper legs and buttocks of a user and maximizes pressure relief, stability, comfort, durability and maintainability.

SUMMARY

The present invention seeks to provide an improved seat cushion.

There is thus provided in accordance with an embodiment of the present invention a seat cushion provided for supporting a sitting person, including a seat portion having an upwardly facing surface and a downwardly facing surface; a plurality of mutually spaced inclined grooves formed in the seat portion; wherein the inclined grooves extend along at least a portion of the distance between the upwardly facing surface and the downwardly facing surface.

Preferably, the inclined grooves extend upwardly from the downwardly facing surface. Alternatively, the inclined grooves extend downwardly from the upwardly facing surface. Further preferably, the inclined grooves have a circular cross-section.

In accordance with an embodiment of the present invention, the plurality of inclined grooves extends in parallel to each other. Preferably, the plurality of inclined grooves extends at an angle relative to the downwardly facing surface. Further preferably, the plurality of inclined grooves extends at an acute angle relative to the downwardly facing surface. Alternatively, the plurality of inclined grooves extends at an obtuse angle relative to the downwardly facing surface.

Preferably, the plurality of inclined grooves extends from the downwardly facing surface to the upwardly facing surface.

Further preferably, the plurality of inclined grooves enables upon application of pressure on the seat portion, even pressure distribution across the volume of the seat portion.

In accordance with an embodiment of the present invention, upon application of pressure on the seat portion, a stress exerted on a body portion of the sitting person remains substantially constant notwithstanding the extent of strain formed within the seat portion. Preferably, the seat portion is made of high resiliency foam.

In accordance with an embodiment of the present invention, a seat cushion provided for supporting a sitting person, including a seat portion and a tilting mechanism coupled thereto and having a swivel point adapted to provide fluctuations of pressure exerted on a body portion of the sitting person upon application of pressure outside of a central portion of the seat portion.

Preferably, the tilting mechanism includes a first rigid plate, a second rigid plate and an intermediate substrate disposed between the first and second rigid plates. Further preferably, the intermediate substrate is made of memory foam. Still preferably, the first plate, the second plate and the intermediate substrate are attached to each other.

In accordance with an embodiment of the present invention, the swivel point is a protrusion formed on the first rigid plate and engages the second rigid plate. Preferably, the seat portion is mounted onto the tilting mechanism. Further preferably, the protrusion serves as a see-saw point for the seat portion. Preferably, a plurality of mutually spaced inclined grooves is formed in the seat portion.

In accordance with an embodiment of the present invention, a seat cushion provided for supporting a sitting person, including a seat portion having an upwardly facing surface and a downwardly facing surface; a plurality of mutually spaced inclined grooves formed in the seat portion; wherein the inclined grooves extend along at least a portion of the distance between the upwardly facing surface and the downwardly facing surface and also including a tilting mechanism.

Preferably, the grooves are formed during a molding process of the seat portion. Alternatively, the grooves are drilled within the seat portion.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

The present invention will be understood and appreciated more fully from the following detailed description, taken in conjunction with the drawings in which.

DETAILED DESCRIPTION

In accordance with an embodiment of the present invention, an improved seat cushion is provided, which enables minimization of skin stress and even pressure distribution on the body of a patient.

Figure 1:
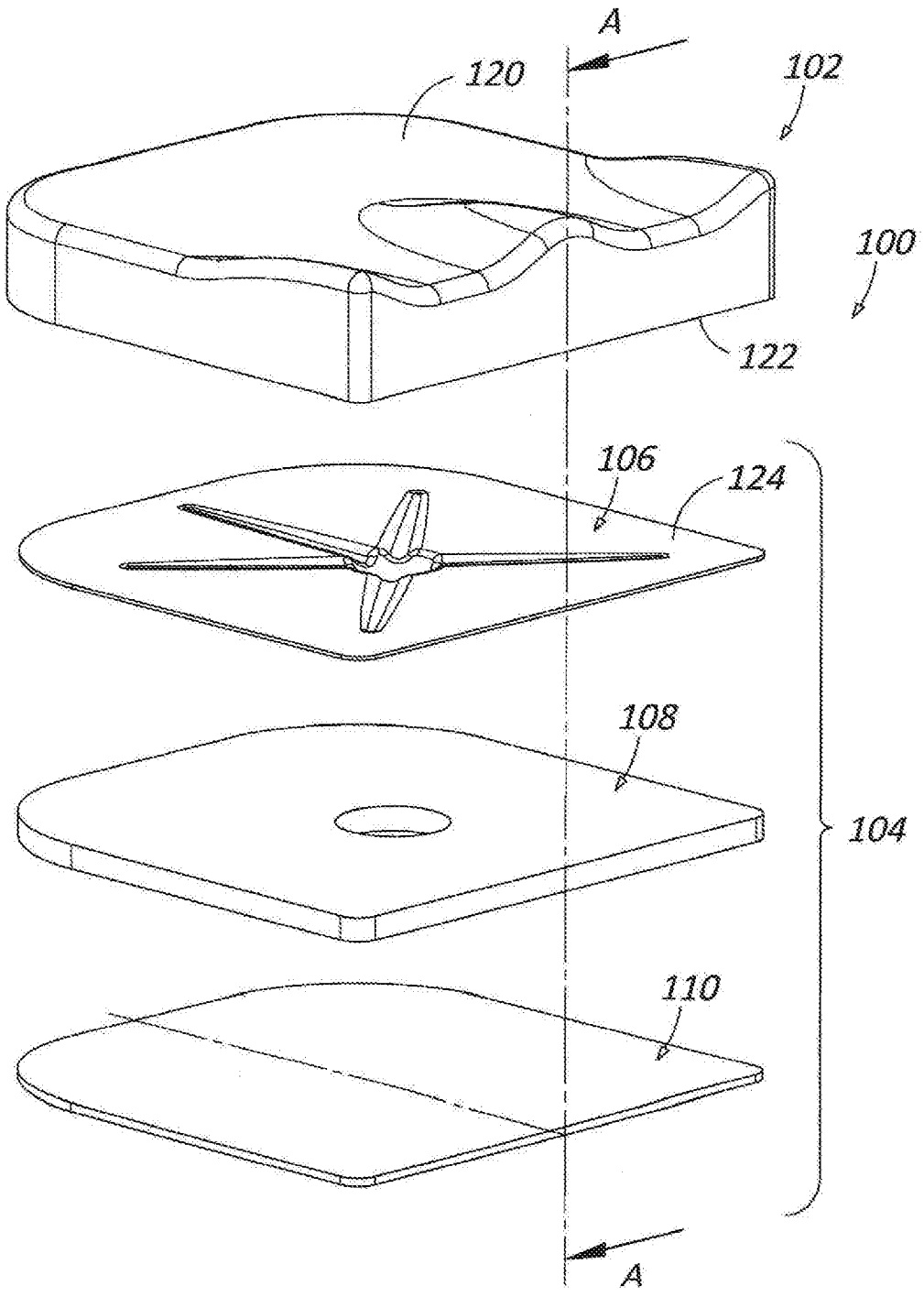
FIG. 1 is a simplified exploded pictorial view of a seat cushion having a tilting mechanism, constructed and operative in accordance with an embodiment of the present invention.

Reference is now made to FIG. 1, which is a simplified exploded pictorial view of a seat cushion having a tilting mechanism, constructed and operative in accordance with an embodiment of the present invention.

It is seen in FIG. 1 that a seat cushion 100 preferably includes a seat portion 102 and a tilting mechanism 104. Tilting mechanism 104 preferably includes an upper support plate 106, which also serves as the support of seat portion 102, an intermediate foam layer 108 and a bottom support plate 110.

It is further seen in FIG. 1 that seat portion 102 has an upwardly facing surface 120, shaped to fit the buttocks and upper leg portions (thighs) of a user sitting on the seat cushion 100.

Seat portion 102 also has a downwardly facing surface 122, adapted to be mounted onto or disposed on an upwardly facing surface 124 of the upper support plate 106.

Upper support plate 106, intermediate foam layer 108 and bottom support plate 110 are preferably attached to each other.

Figure 2:
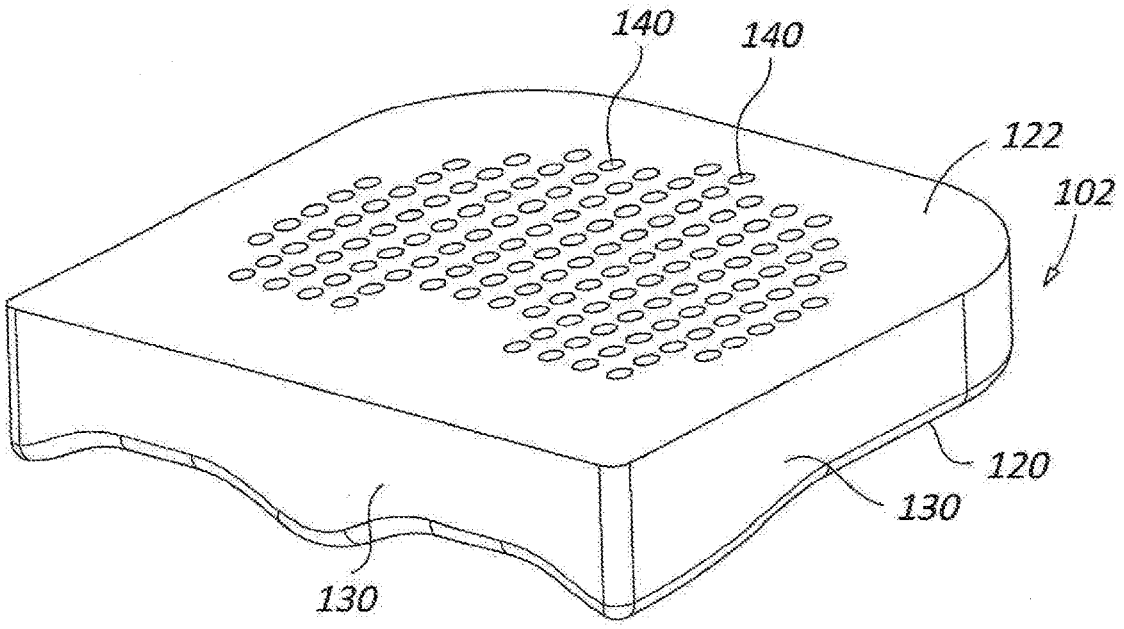
FIG. 2 is a simplified pictorial view, shown from a downward direction, of a seat portion of the seat cushion of FIG. 1.

Reference is now made to FIG. 2, which is a simplified pictorial view, shown from a downward direction, of seat portion 102 of the seat cushion 100 of FIG. 1.

Seat portion 102 is an integrally formed resilient element, preferably made of a high resiliency foam, such as, for example, high resiliency polyurethane.

Seat portion 102 has a plurality of side wall surfaces 130 extending between upwardly facing surface 120 and downwardly facing surface 122. The thickness of the seat portion 102 may vary in the range of 2"-6", preferably the thickness of the seat portion 102 is approximately 4".

It is a particular feature of an embodiment of the present invention that a plurality of inclined grooves 140 are formed within seat portion 102 and extend from downwardly facing surface 122 thereof. It is appreciated that inclined grooves 140 are formed generally at the area of the seat portion 102 where most of the load applied by the weight of the sitting person is exerted.

It is noted that inclined grooves 140 are preferably cylindrical. Alternatively, the inclined grooves 140 can be tapered, forming grooves shaped as truncated cones. It is appreciated that inclined grooves 140 can have any other geometrical shape.

It is noted that the inclined grooves 140 can be formed during the molding process of the seat portion 102 or, alternatively, be drilled within a pre-formed seat portion 102.

Figure 3:
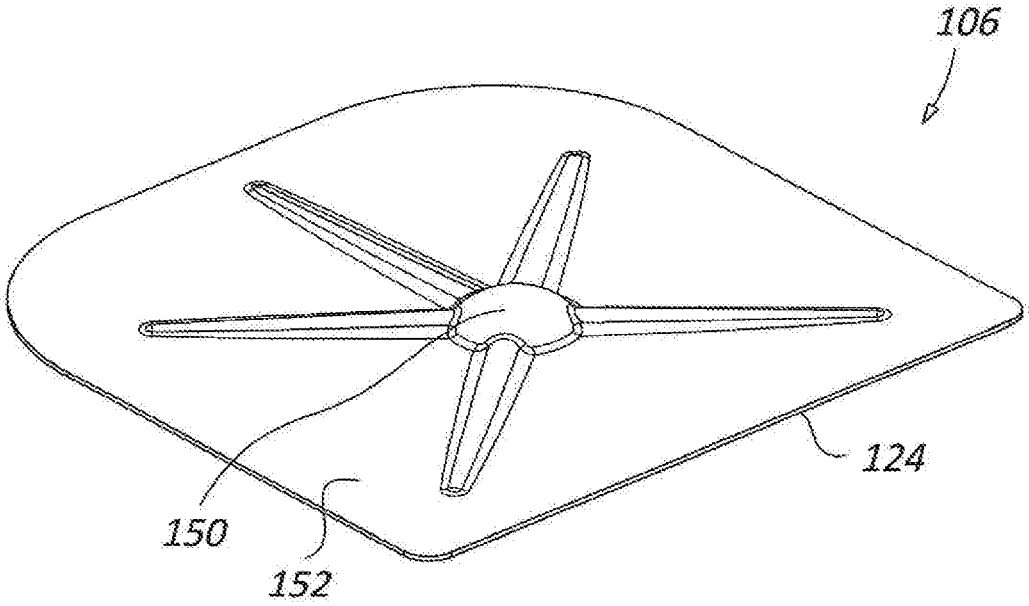
FIG. 3 is a simplified pictorial view, shown from a downward direction, of an upper plate forming part of the tilting mechanism of the seat cushion of FIG. 1.

Reference is now made to FIG. 3, which is a simplified pictorial view, shown from a downward direction, of the upper plate 106, forming part of the tilting mechanism 104 of the seat cushion 100 of FIG. 1.

Upper plate 106 is an integrally formed rigid element, preferably made of plywood, metal sheet or plastic, for example.

It is a particular feature of an embodiment of the present invention that a semi-spherical protrusion 150 is generally formed on a downwardly facing surface 152 of upper plate 106.

It is appreciated that the semi-spherical protrusion 150 may be integrally formed with upper plate 106, such as by stamping process or may alternatively be fixedly attached to upper plate 106, by means of welding or any other suitable method.

It is noted that protrusion 150 may alternatively pertain any suitable geometrical shape that would provide for a see-saw point for the seat portion 102, which is mounted on top of upper plate 106.

Figure 4:
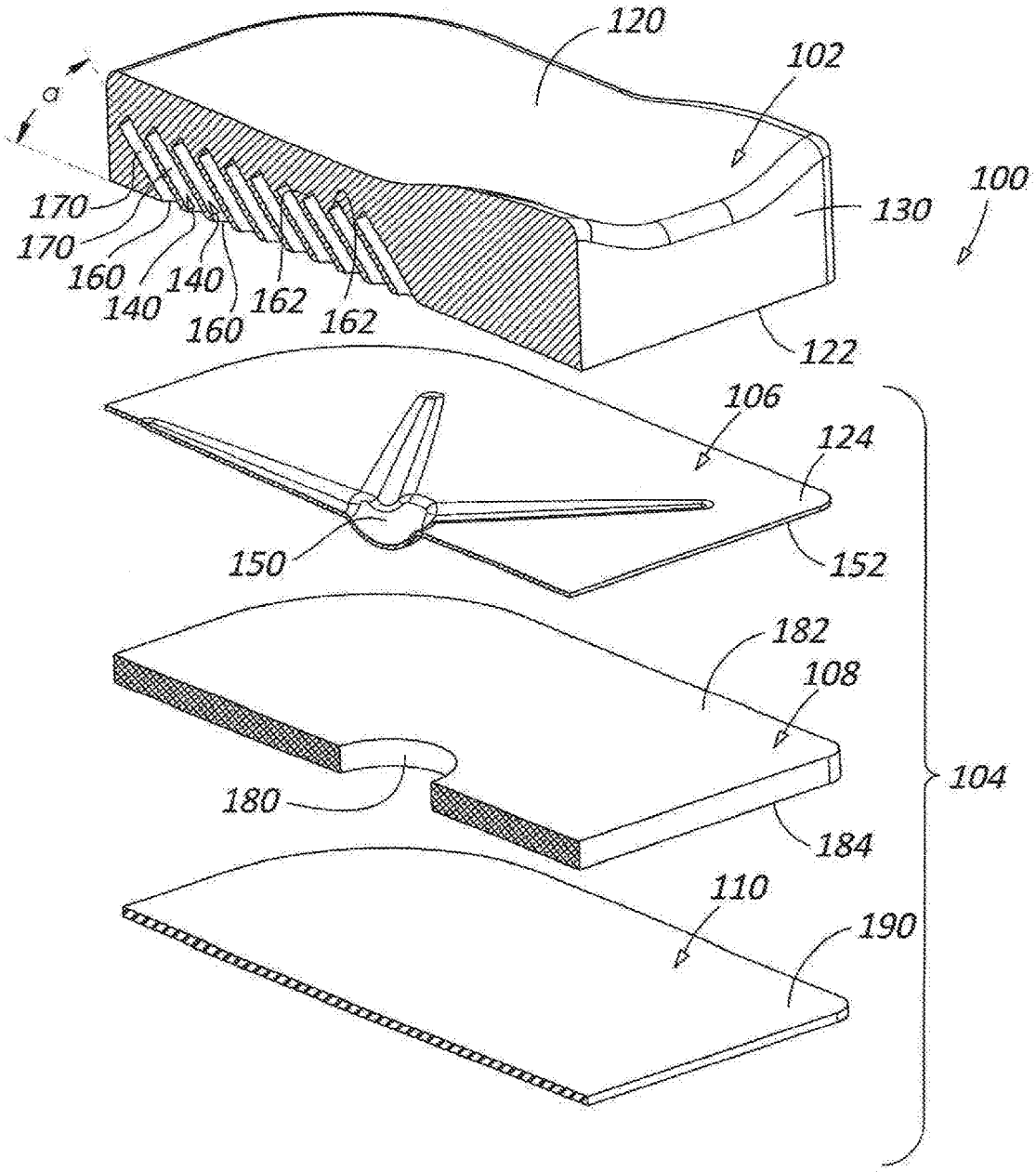
FIG. 4 is a simplified exploded section view of a seat cushion having a tilting mechanism of FIG. 1 in accordance with a first embodiment of the present invention, section being taken along lines A-A in FIG. 1.

Reference is now made to FIG. 4, which is a simplified exploded section view of the seat cushion 100 having a tilting mechanism 104 of FIG. 1 in accordance with a first embodiment of the present invention, section being taken along lines A-A in FIG. 1.

It is seen in FIG. 4 that in accordance with first embodiment of the present invention, plurality of inclined grooves 140 extend from apertures 160 formed in downwardly facing surface 122 of seat portion 102.

It is a particular feature of an embodiment of the present invention that the inclined grooves 140 are mutually spaced apart from each other and each extends rearwardly at an angle "a" with respect to downwardly facing surface 122 of seat portion 102. All inclined grooves 140 are preferably parallel to each other.

It is appreciated that inclined grooves 140 can alternatively be inclined forwardly or follow herring bone pattern to the sides.

It is noted that angle "a" can vary in the range between 30 and 60 degrees.

In accordance with an embodiment shown in FIG. 4, angle "a" is approximately 60 degrees.

It is particularly noted that in accordance with an embodiment of the present invention, the plurality of inclined grooves 140 preferably extends at an angle relative to the downwardly facing surface 122. Further preferably, the plurality of inclined grooves 140 extends at an acute angle relative to the downwardly facing surface 122. Alternatively, the plurality of inclined grooves 140 extends at an obtuse angle relative to the downwardly facing surface 122.

It is seen in FIG. 4 that inclined grooves 140 extend preferably up to more than half of the thickness of the seat portion 102 and define an upward end 162 adjacent and downwardly spaced from upwardly facing surface 120 of seat portion 102.

Diameter of the inclined grooves 140 can vary in the range between 0.5 inch to 1 inch. Preferably, the diameter of the inclined grooves is approximately 0.5 inch. It is noted that in accordance with an embodiment of the present invention, the inclined grooves 140 may alternatively be of any other diameter.

It is appreciated that each of the plurality of inclined grooves 140 defines an interior volume 170 therewithin.

It is particularly noted that inclined grooves 140 alternatively extend from respective apertures formed in the upwardly facing surface 120 of seat portion 102 and extend generally downwardly towards downwardly facing surface 122 or extending through the entire thickness of the seat portion 102.

It is further seen in FIG. 4 that a central aperture 180 is formed through intermediate foam layer 108, and being adapted for insertion of protrusion 150 therethrough.

Intermediate foam layer 108 defines an upwardly facing surface 182, adapted to engage downwardly facing surface 152 of upper plate 106, and a downwardly facing surface 184, adapted to engage an upwardly facing surface 190 of bottom support plate 110.

It is further appreciated that protrusion 150 is adapted to be seated on upwardly facing surface 190 of bottom support plate 110 when assembled.

It is a particular feature of an embodiment of the present invention that the intermediate foam layer 108 is made of a memory foam.

It is appreciated that the thickness of upper plate 106 may vary in the range between 0.5 inch to 1 inch, depending upon material. The thickness of intermediate foam layer 108 may vary in the range of 0.75 inch to 1.25 inch. The thickness of bottom support plate 110 may vary in the range between 0.5 inch to 1.5 inch depending upon material. It is noted that in accordance with an embodiment of the present invention, the thickness of any of the upper plate 106, foam layer 108 and bottom support plate 110 may be different than the specified above.

Figure 5:
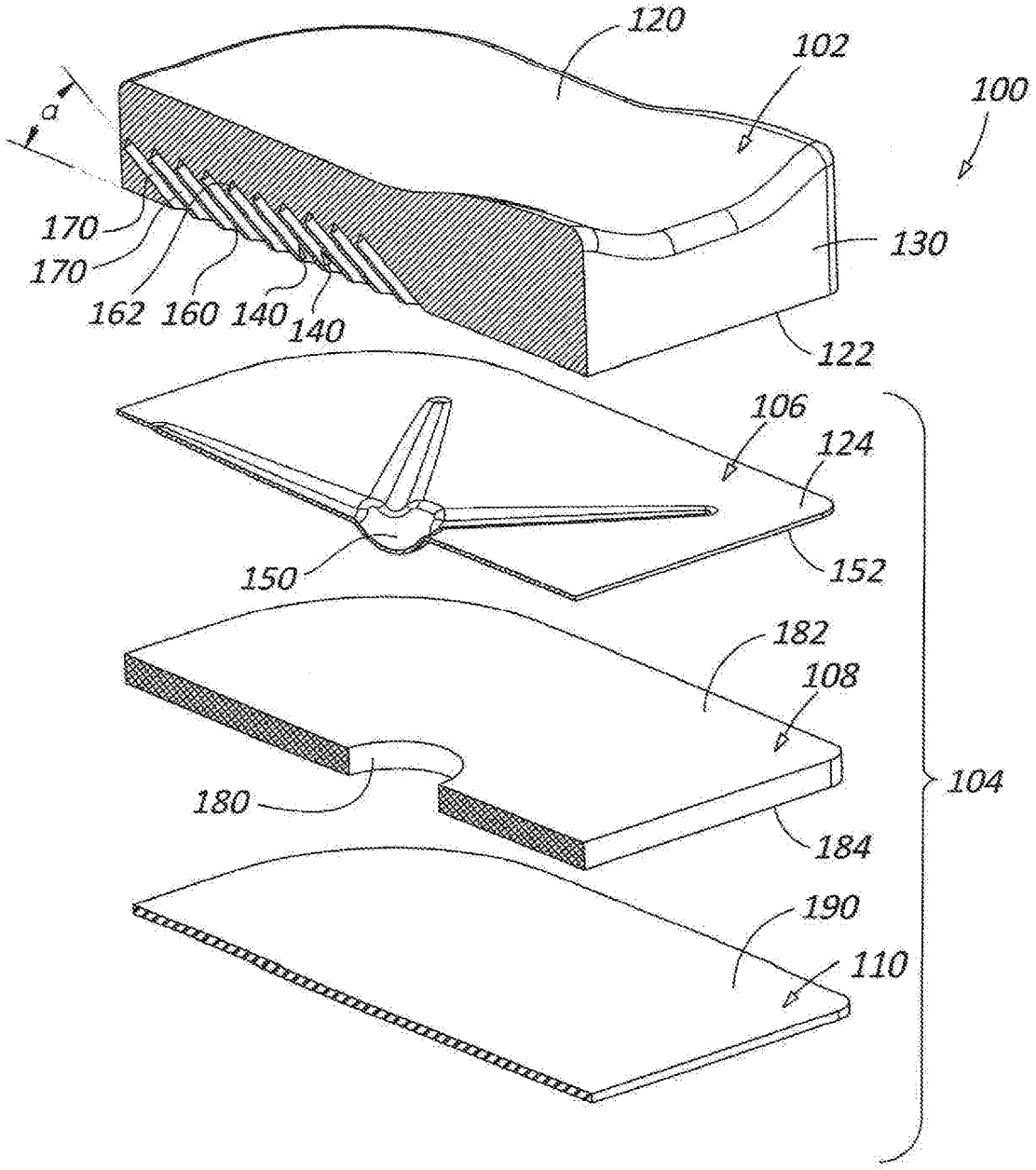
FIG. 5 is a simplified exploded section view of a seat cushion having a tilting mechanism of FIG. 1 in accordance with a second embodiment of the present invention, section being taken along lines A-A in FIG. 1.

Reference is now made to FIG. 5, which is a simplified exploded section view of seat cushion 100 having a tilting mechanism 104 of FIG. 1 in accordance with a second embodiment of the present invention, section being taken along lines A-A in FIG. 1.

It is seen in FIG. 5 that in accordance with second embodiment of the present invention, plurality of inclined grooves 140 extend from apertures 160 formed in downwardly facing surface 122 of seat portion 102.

It is a particular feature of an embodiment of the present invention that the inclined grooves 140 are mutually spaced apart from each other and each extends rearwardly at an angle "a" with respect to downwardly facing surface 122 of seat portion 102. All inclined grooves 140 preferably extend in parallel to each other.

It is noted that angle "a" can vary in the range between 30-60 degrees.

In accordance with another embodiment shown in FIG. 5, angle "a" is approximately 30 degrees.

It is particularly noted that in accordance with an embodiment of the present invention, the plurality of inclined grooves 140 preferably extends at an angle relative to the downwardly facing surface 122. Further preferably, the plurality of inclined grooves 140 extends at an acute angle relative to the downwardly facing surface 122. Alternatively, the plurality of inclined grooves 140 extends at an obtuse angle relative to the downwardly facing surface 122.

It is seen in FIG. 5 that inclined grooves 140 extend preferably up to more than half of the thickness of the seat portion 102 and define an upward end 162 adjacent and downwardly spaced from upwardly facing surface 120 of seat portion 102.

It is appreciated that each of the plurality of inclined grooves 140 defines an interior volume 170 therewithin.

It is particularly noted that inclined grooves 140 alternatively extend from respective apertures formed in the upwardly facing surface 120 of seat portion 102 and extend generally downwardly towards downwardly facing surface 122 or extending through the entire thickness of the seat portion 102.

It is further seen in FIG. 5 that central aperture 180 is formed through intermediate foam layer 108, and being adapted for insertion of protrusion 150 therethrough.

Intermediate foam layer 108 defines an upwardly facing surface 182, adapted to engage downwardly facing surface 152 of upper plate 106, and downwardly facing surface 184, adapted to engage an upwardly facing surface 190 of bottom support plate 110.

It is further appreciated that protrusion 150 is adapted to be seated on upwardly facing surface 190 of bottom support plate 110 when assembled.

It is a particular feature of an embodiment of the present invention that the intermediate foam layer 108 is made of a memory foam.

Figure 6:
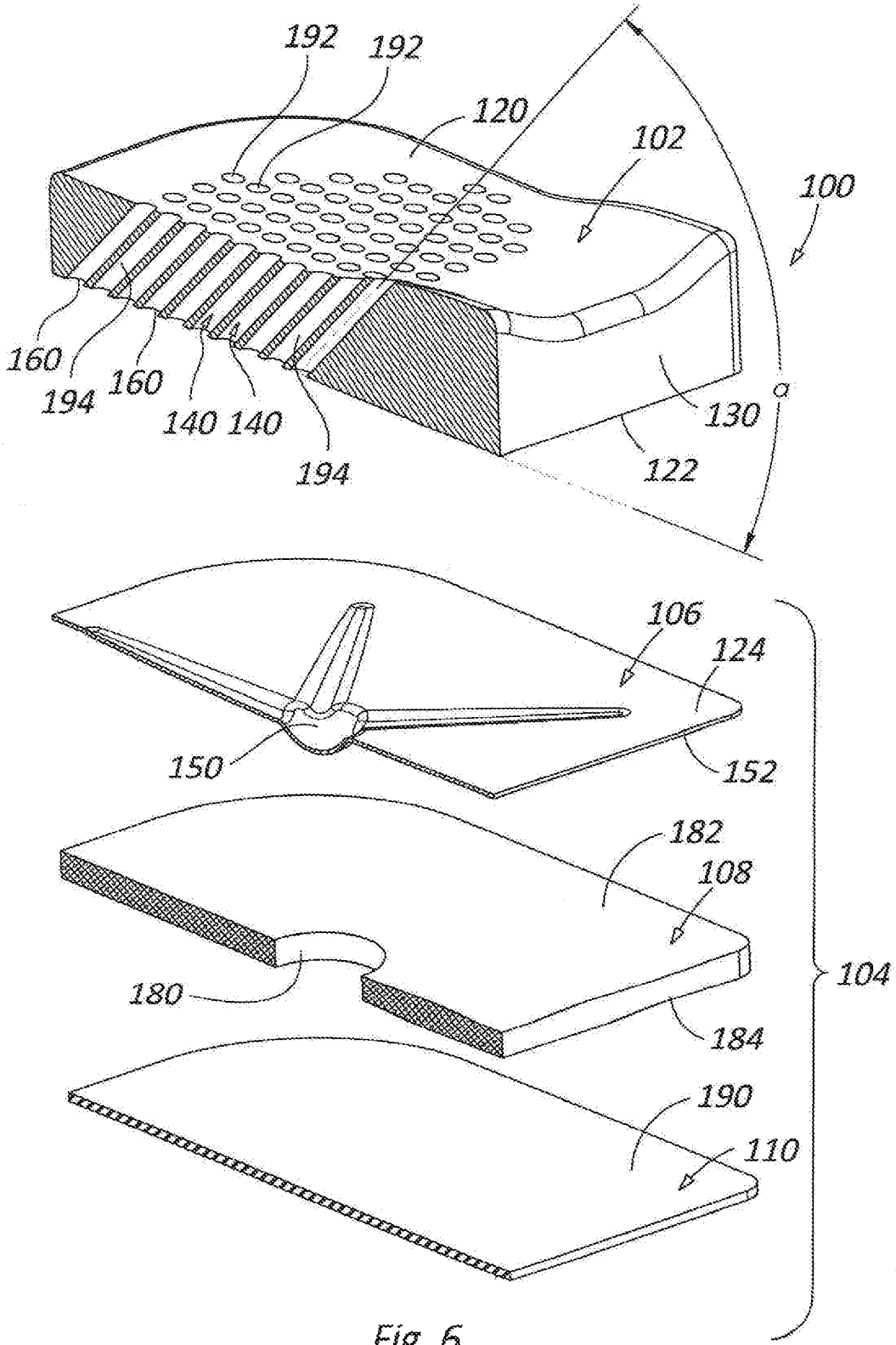
FIG. 6 is a simplified exploded section view of a seat cushion having a tilting mechanism of FIG. 1 in accordance with a third embodiment of the present invention, section being taken along lines A-A in FIG. 1.

Reference is now made to FIG. 6, which is a simplified exploded section view of seat cushion 100 having a tilting mechanism 104 of FIG. 1 in accordance with a third embodiment of the present invention, section being taken along lines A-A in FIG. 1.

It is seen in FIG. 6 that in accordance with third embodiment of the present invention, plurality of inclined grooves 140 extend from apertures 160 formed in downwardly facing surface 122 of seat portion 102.

It is a particular feature of an embodiment of the present invention that the inclined grooves 140 are mutually spaced apart from each other and each extends forwardly at an angle "a" with respect to downwardly facing surface 122 of seat portion 102. All inclined grooves 140 preferably extend in parallel to each other.

It is noted that angle "a" can vary in the range between 30-60 degrees.

In accordance with another embodiment shown in FIG. 6, angle "a" is approximately 60 degrees.

It is particularly noted that in accordance with an embodiment of the present invention, the plurality of inclined grooves 140 preferably extends at an angle relative to the downwardly facing surface 122. Further preferably, the plurality of inclined grooves 140 extends at an acute angle relative to the downwardly facing surface 122. Alternatively, the plurality of inclined grooves 140 extends at an obtuse angle relative to the downwardly facing surface 122.

It is a particular feature of an embodiment of the present invention that inclined grooves 140 extend entirely through the entire thickness of seat portion 102, thus communicating with a plurality of apertures 192 formed in upwardly facing surface 120 of seat portion 102.

It is appreciated that inclined grooves 140 formed in accordance with third embodiment shown in FIG. 6, define inner volume 194, which is substantially greater than inner volume 170 defined by inclined grooves 140 in accordance with first or second embodiments, shown in FIGS. 4 & 5 respectively.

It is further seen in FIG. 6 that central aperture 180 is formed through intermediate foam layer 108, and being adapted for insertion of protrusion 150 therethrough.

Intermediate foam layer 108 defines an upwardly facing surface 182, adapted to engage downwardly facing surface 152 of upper plate 106, and downwardly facing surface 184, adapted to engage an upwardly facing surface 190 of bottom support plate 110.

It is further appreciated that protrusion 150 is adapted to be seated on upwardly facing surface 190 of bottom support plate 110 when assembled.

It is a particular feature of an embodiment of the present invention that the intermediate foam layer 108 is made of a memory foam.

Figure 7:
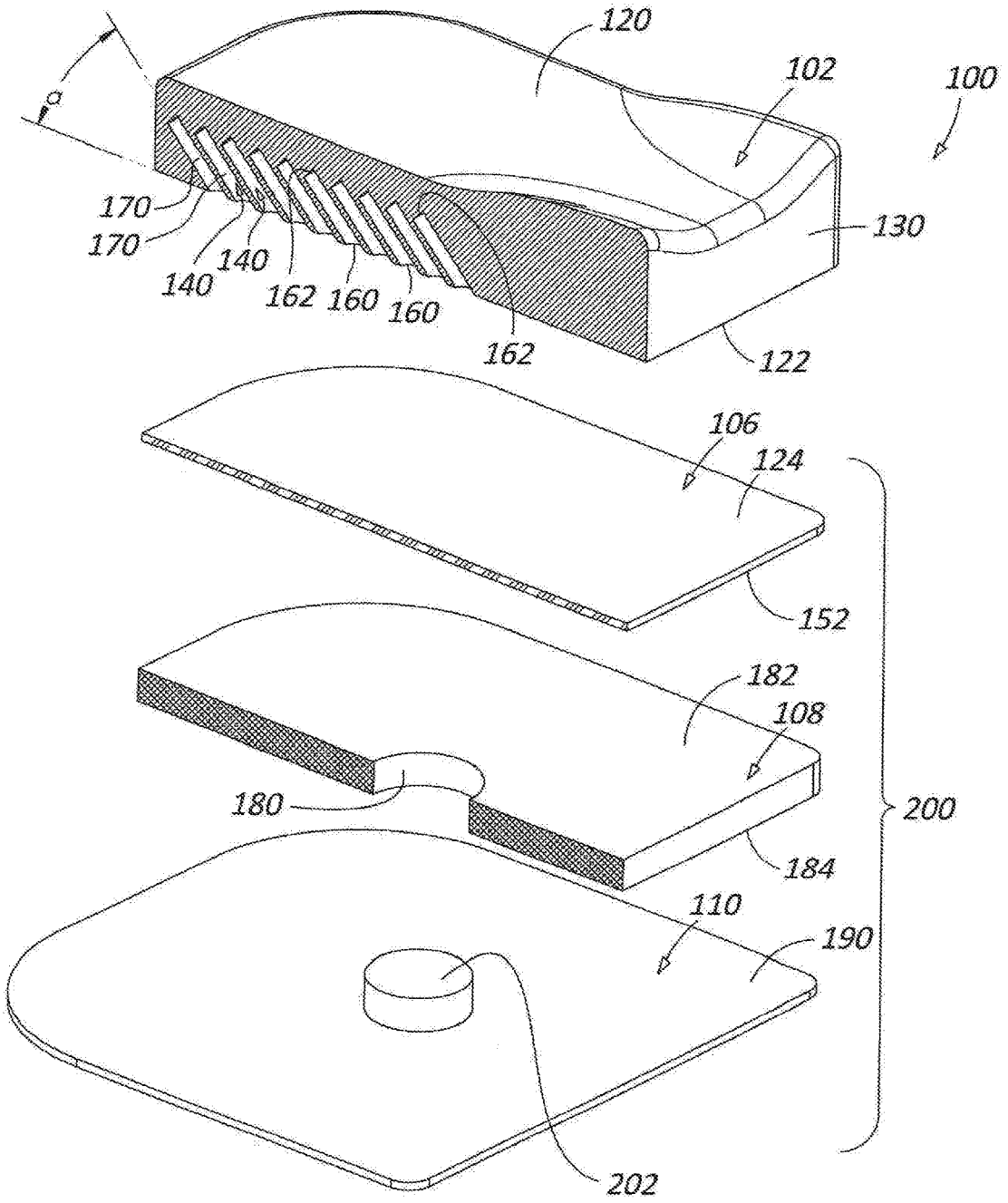
FIG. 7 is a simplified exploded section view of seat cushion of FIG. 1, having a different tilting mechanism in accordance with another embodiment of the present invention, section being taken along lines A-A in FIG. 1, showing a different tilting mechanism.

Reference is now made to FIG. 7, which is a simplified exploded section view of seat cushion 100 of FIG. 1, having a different tilting mechanism in accordance with another embodiment of the present invention, section being taken along lines A-A in FIG. 1, showing a different tilting mechanism.

It is seen in FIG. 7 that in accordance with another embodiment of the present invention, plurality of inclined grooves 140 extend from apertures 160 formed in downwardly facing surface 122 of seat portion 102.

It is a particular feature of an embodiment of the present invention that the inclined grooves 140 are mutually spaced apart from each other and each extends rearwardly at an angle "a" with respect to downwardly facing surface 122 of seat portion 102. All inclined grooves 140 preferably extend in parallel to each other.

It is noted that angle "a" can vary in the range between 30-60 degrees.

In accordance with another embodiment shown in FIG. 7, angle "a" is approximately 60 degrees.

It is particularly noted that in accordance with an embodiment of the present invention, the plurality of inclined grooves 140 preferably extends at an angle relative to the downwardly facing surface 122. Further preferably, the plurality of inclined grooves 140 extends at an acute angle relative to the downwardly facing surface 122. Alternatively, the plurality of inclined grooves 140 extends at an obtuse angle relative to the downwardly facing surface 122.

It is seen in FIG. 7 that inclined grooves 140 extend preferably up to more than half of the thickness of the seat portion 102 and define an upward end 162 adjacent and downwardly spaced from upwardly facing surface 120 of seat portion 102.

It is appreciated that each of the plurality of inclined grooves 140 defines an interior volume 170 therewithin.

It is particularly noted that inclined grooves 140 alternatively extend from respective apertures formed in the upwardly facing surface 120 of seat portion 102 and extend generally downwardly towards downwardly facing surface 122 or extending through the entire thickness of the seat portion 102.

In accordance with another embodiment of the present invention, an alternative tilting mechanism 200 is shown as part of seat cushion 100.

It is particularly seen in FIG. 7 that upper plate 106 defines planar upwardly facing surface 124 and planar downwardly facing surface 152.

Intermediate foam layer 108 defines an upwardly facing surface 182, adapted to engage downwardly facing surface 152 of upper plate 106, and downwardly facing surface 184, adapted to engage an upwardly facing surface 190 of bottom support plate 110. Central aperture 180 is formed through intermediate foam layer 108.

It is further appreciated that protrusion 202 is formed on upwardly facing surface 190 of bottom support plate 110 or integrally made therewith. Protrusion 202 is preferably made of a resilient material, such as rubber, for example.

It is appreciated that protrusion 202 is adapted to extend through aperture 180 formed in intermediate foam layer 108 and engage downwardly facing surface 152 of upper plate 106, when seat cushion 100 is assembled.

It is a particular feature of an embodiment of the present invention that the intermediate foam layer 108 is made of a memory foam.

Figure 8A:
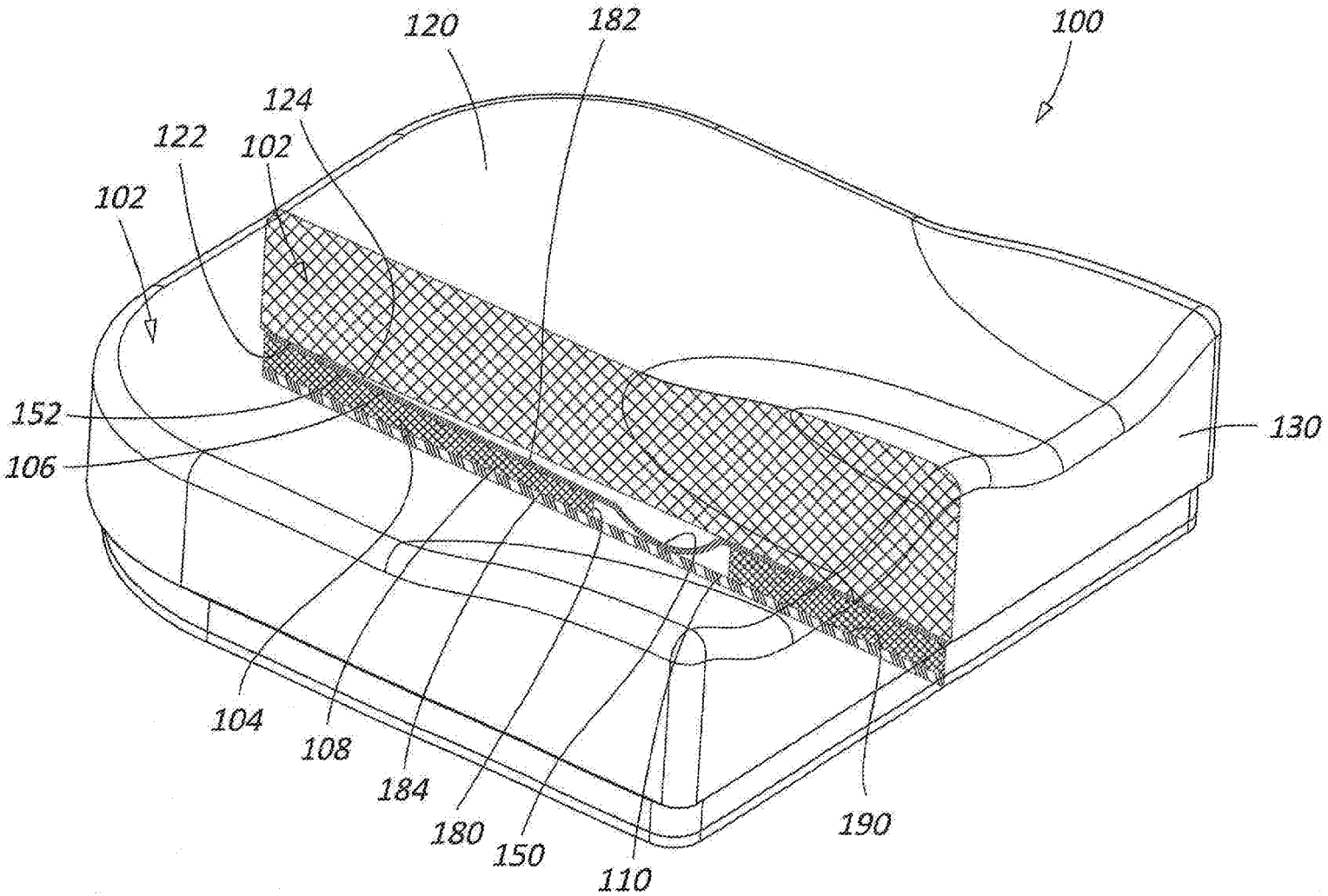
FIGS. 8A & 8B are simplified respective assembled pictorial and section view of seat cushion of FIG. 1 in accordance with an embodiment of the present invention, section being taken along lines B-B in FIG. 8A.
Figure 8B:
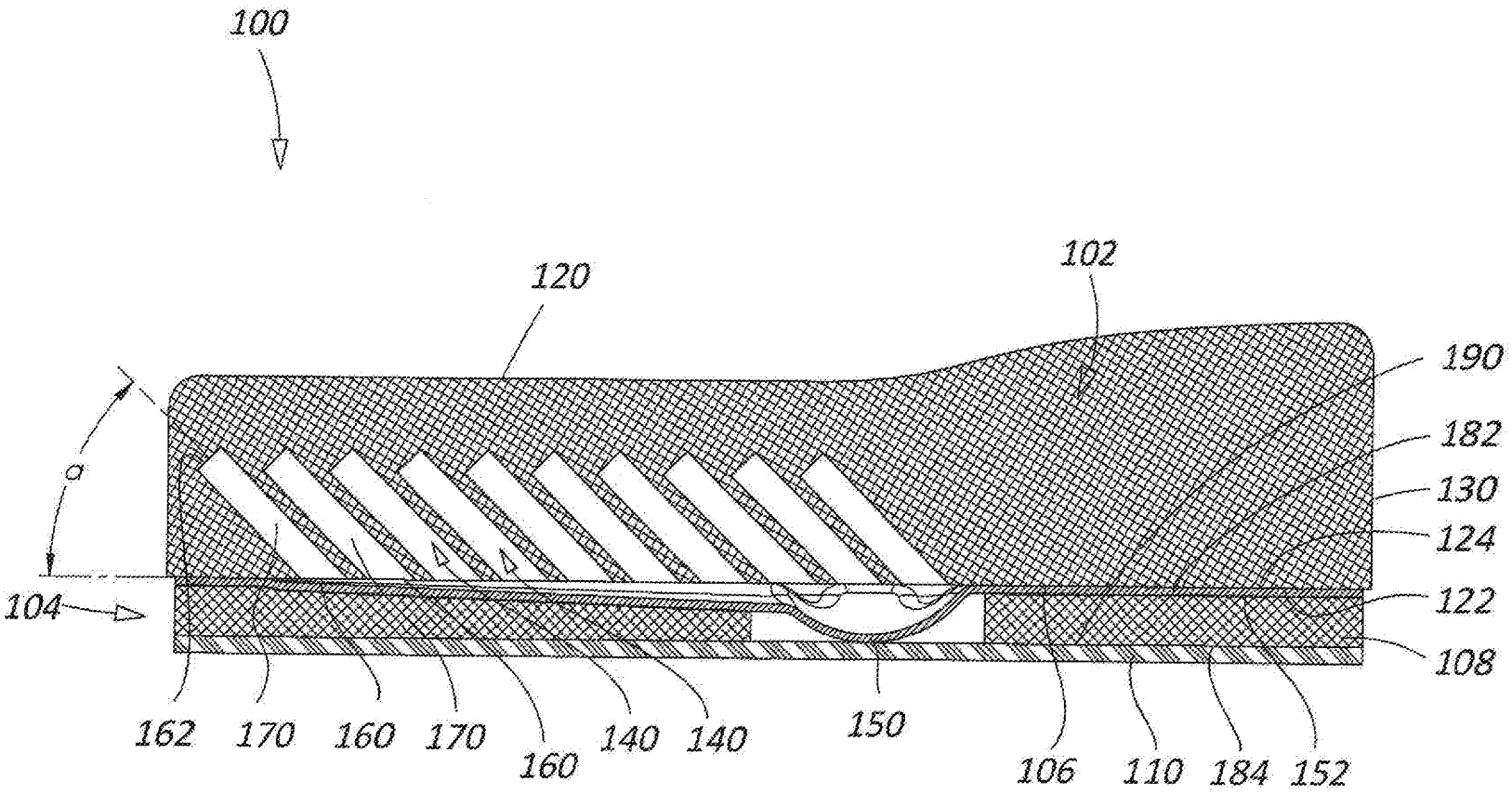

Reference is now made to FIGS. 8A & 8B, which are simplified respective assembled pictorial and section views of seat cushion 100 of FIG. 1 in accordance with an embodiment of the present invention, section being taken along lines B-B in FIG. 8A.

It is seen in FIGS. 8A & 8B that seat portion 102 is seated above tilting mechanism 104, such that downwardly facing surface 122 of seat portion 102 is supported on upwardly facing surface 124 of upper plate 106. The components of tilting mechanism 104 are attached together, such that downwardly facing surface 152 of upper plate 106 engage upwardly facing surface 182 of intermediate foam layer 108 and downwardly facing surface 184 of intermediate foam layer 108 engages upwardly facing surface 190 of bottom support plate 110. Protrusion 150 of upper plate 106 is enclosed between upper plate 106 and bottom support plate 110, such that protrusion 150 engages upwardly facing surface 190 of bottom support plate 110.

It is a particular feature of an embodiment of the present invention that the seat portion 102, which is shown and described in accordance with the embodiments of the present invention, can be used as the seat cushion separately, without being mounted onto the tilting mechanism 104.

It is another particular feature of an embodiment of the present invention that the tilting mechanism 104, as shown and described in accordance with the embodiments of the present invention, can be used separately with any known seat portion, not only with seat portion 102 of the present invention.

Figure 9:
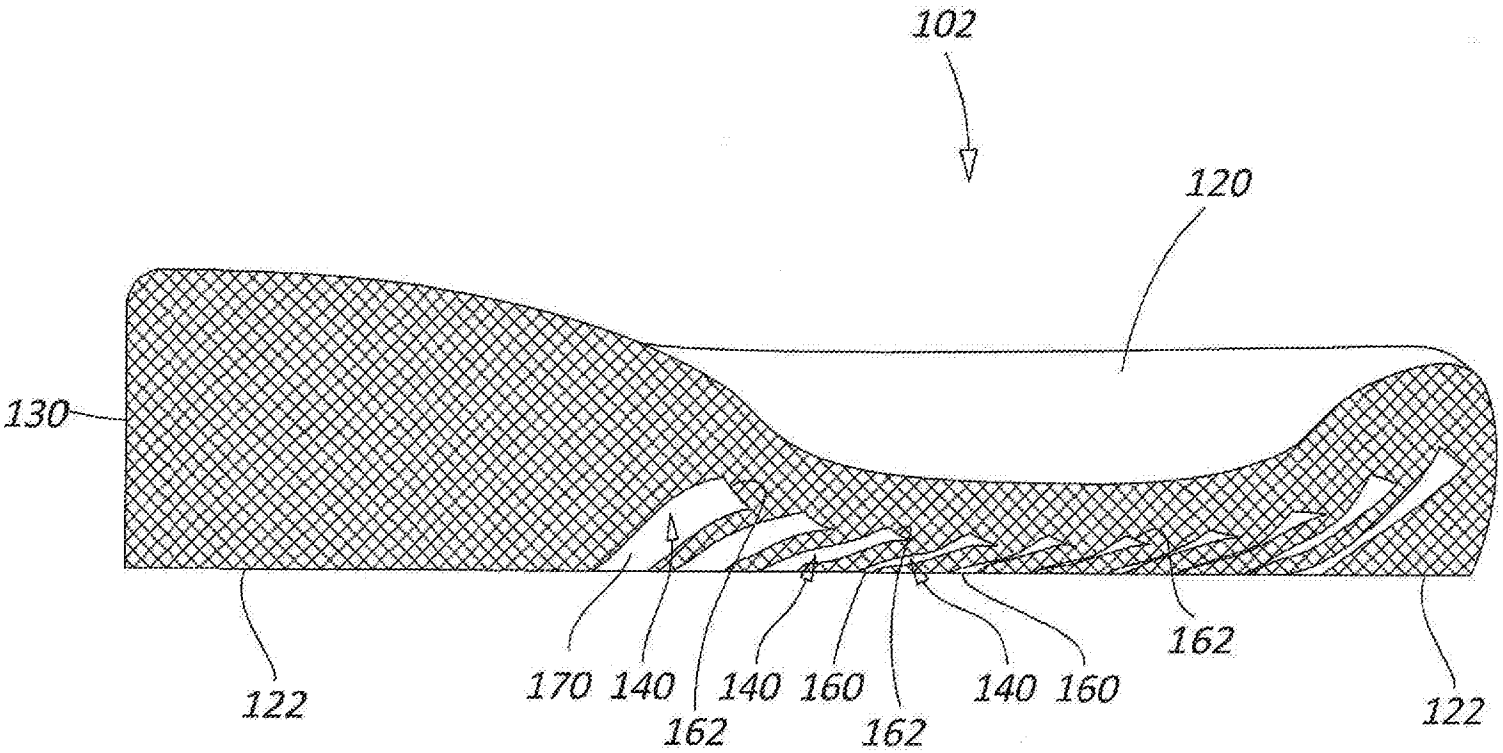
FIG. 9 is a simplified section view of simulated deformation of the seat portion of FIG. 2 upon load application thereon.
Figure 10:
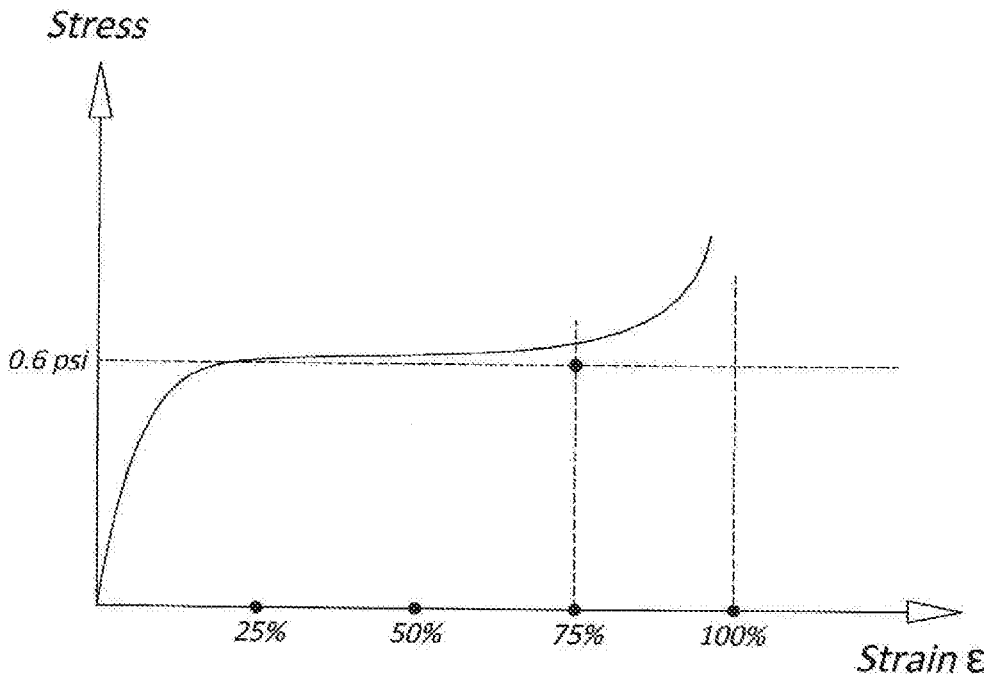
FIG. 10 is a simplified graphical illustration of strain created in seat portion of FIG. 2 as function of stress applied on the seat portion.

Reference is now made collectively to FIG. 9, which is a simplified section view of simulated deformation of the seat portion of FIG. 2 upon load application thereon and to FIG. 10, which is a simplified graphical illustration of strain created in seat portion 102 of FIG. 2 as function of stress applied on the seat portion 102.

It is seen in FIG. 9 how the plurality of inclined grooves 140 formed in seat portion 102, as is particularly shown in FIGS. 4-7, are deflected upon load that is applied on upwardly facing surface 120 of seat portion 102 by a person sitting on the seat cushion 100. It is seen that inclined grooves 140 are partially collapsed upon load applied by a sitting person.

Bone structure prominences of a sitting person create areas of high pressure on the upwardly facing surface 120 of seat portion 102. Inclined grooves 140 formed in seat portion 102 enable resiliency adjustment of the of the seat portion 102 based on both the load applied thereon and penetration depth of the body into the seat portion 102. Particularly, bones penetrate through seat portion 102, whereas soft tissues of the sitting person are supported against upwardly facing surface 120 of seat portion 102. When load is initially applied on the upwardly facing surface 120 of seat portion 102, it is applied on a perforated area having reduced resiliency. Upon this initial load application, inclined grooves 140 gradually collapse, as particularly seen in FIG. 9, in the most loaded areas, at which stage the inner volume 170 of inclined grooves 140 is decreased. The areas of seat portion 102 that are disposed in close proximity to the collapsed inclined grooves 140 now initiate the material densification stage, while the resiliency in all other areas is still low, as soft tissues do not provide sufficient load which would cause collapsing of the inclined grooves 140, thus pressure is distributed evenly across the entire contact surface between the sitting person and the upwardly facing surface 120 of seat portion 102.

It is appreciated that forming inclined grooves 140 within seat portion 102 enables reducing the resiliency of seat portion 102 both as function of load applied thereon and as function of penetration depth of a sitting person body portion, thus shear stress on the skin of the sitting person is reduced when sitting on a seat cushion 100, constructed and operative in accordance with an embodiment of the present invention.

It is a well-known medical fact that the desired stress exerted on a soft tissue of a sitting person is approximately 0.6 psi.

Strain is defined for the purposes of this description as being the penetration depth of a sitting person body portion into the seat portion 102.

It is a particular feature of an embodiment of the present invention that during the major extent of strain formation within seat portion 102, the stress exerted on body portion of a sitting person remains constant, at approximately the medically desired stress of 0.6 psi.

It is particularly seen in FIG. 10 that at least at the range between 25%-75% of strain formed in seat portion 102, stress exerted on body portion of a sitting person remains substantially constant.

It is a particular feature of an embodiment of the present invention that inclined grooves 140 formed in seat portion 102 enable even volume pressure distribution, not only across the upwardly facing surface 120 of seat portion 102, but also within the volume thereof upon load application on seat cushion 100.

It is noted that in alternative embodiment of the present invention, an additional memory foam layer may be disposed on top of upwardly facing surface 120 of seat portion 102 to enhance equalization of pressure distribution.

It is a further particular feature of an embodiment of the present invention that inclined grooves 140 provided in seat portion 102 enable pressure distribution in all three dimensions of the seat portion 102.

Seat portion 102 is an integrally formed element, having no layers therewithin, thus any shear stress that would have been created in a seat cushion formed with layers is eliminated in accordance with an embodiment of the present invention, thus providing for non-linear strain-stress dependency.

It is appreciated that seat cushion 100 such as seen in FIGS. 4, 5 and 7 is more suitable for heavier-weight people, while seat cushion 100 such as seen in FIG. 6 is more suitable for lighter-weight people, since heavier-weight people need a seat cushion 100 having more support material and less air within seat portion 102, thus inclined grooves 140 which do not extend through the entire thickness of the seat portion 102 are beneficial in this case.

It is noted that the maximum thickness of seat cushion 100 for wheel chairs can be approximately 4 inch due to ergonomical restrictions and the desired pressure applied on the body of a sitting person is approximately 0.6 psi. Seat cushion 100, in accordance with embodiments of the present invention, including a seat portion 102 formed of a high resiliency foam and inclined tunnels formed therwithin, enables creation of non-linear dependency between strain and stress, such that upon immersion of the sitting person body into seat cushion 100, the stress exerted on the body of the person remains constant at around 0.6 psi.

Figure 11:
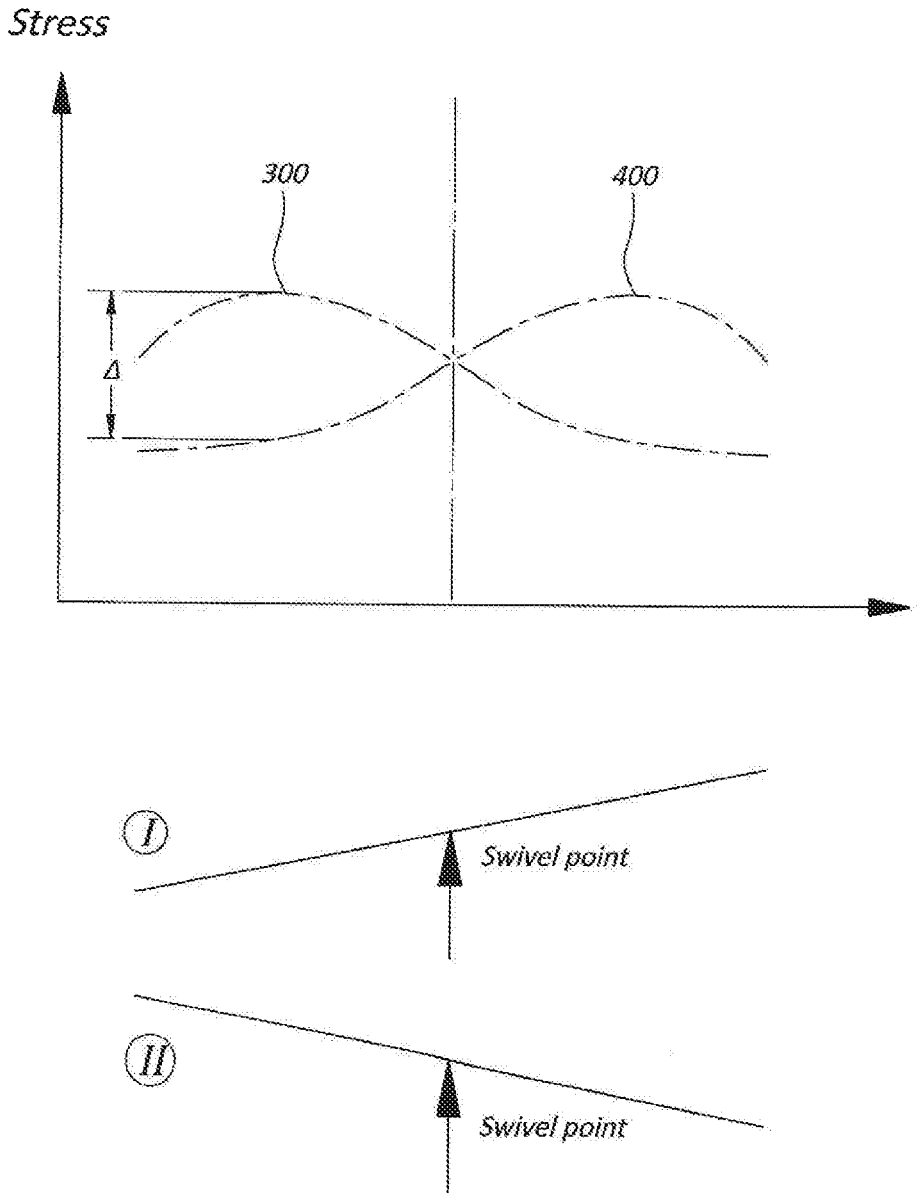
FIG. 11 is a simplified graphical illustration of stress fluctuations as a function of tilting mechanism different operative orientations.

Reference is now made to FIG. 11, which is a simplified graphical illustration of stress fluctuations as a function of tilting mechanism different operative orientations.

The tilting mechanism 104 is seen in FIG. 11 in a first operative orientation. The curves on the graph represent stress fluctuations across the cross-section of seat portion 102 following pivoting of the tilting mechanism 104 about protrusion 150 or 202, serving as a swivel point.

It is seen that a curve which is designated by reference numeral 300 corresponds to swivel point disposed in operative state shown as I, such that stress is high at a first end of seat portion 102 and low at the second end of the seat portion 102. Curve which is designated by reference numeral 400 corresponds to swivel point disposed in operative state shown as II, such that stress is low at the first end of seat portion 102 and high at the second end of the seat portion 102. It is appreciated that pressure fluctuations between the different operative orientations of the tilting mechanism 104 can vary in the range of 50%-60% from a neutral position.

The components of tilting mechanism 104 are attached together, such that downwardly facing surface 152 of upper plate 106 engage upwardly facing surface 182 of intermediate foam layer 108 and downwardly facing surface 184 of intermediate foam layer 108 engages upwardly facing surface 190 of bottom support plate 110. Protrusion 150 of upper plate 106 is enclosed between upper plate 106 and bottom support plate 110, such that protrusion 150 engages upwardly facing surface 190 of bottom support plate 110.

It is a particular feature of an embodiment of the present invention that protrusion 150 serves as a swivel point for a sitting person, whereas the foam layer 108 provides for delayed tilting motion due to the properties of memory foam, which is compressed slowly when reacting to gravity center changes.

It is appreciated that any alternative swivel point, other than that shown as protrusion 150 in FIGS. 4-6 or protrusion 202 in FIG. 7, such as spherical rocking surface, ball joint, spring or pneumatic mechanism, can be employed in tilting mechanism 104 and disposed close to the center of gravity of the person sitting on the seat cushion 100. Tilting mechanism 104 permits free pivoting of the upper plate 106 relative to bottom support plate 110. Pivoting is generally enabled in any direction, such as left-to-right, forward-to-rearward or any combinations thereof.

It is noted that the distance between the upper plate 106 and bottom support plate 110 is approximately 1 inch and foam layer 108 of corresponding thickness made of memory foam is disposed therebetween in order to limit pivoting speed of the upper plate 108.

It is appreciated that pivoting of the upper plate 106 relative to bottom support plate 110 temporarily unloads areas of the human bottom due to redistribution of pressure caused by displacement of centre of gravity. The sensitivity of the tilting mechanism 104 allows for enabling pressure redistribution upon movement of the upper body including head or hands of the sitting person.

It is noted that using of memory foam as foam layer 108 between the upper plate 106 and the bottom support plate 110 allows preserving the sense of stability for the sitting person. Memory shape has a unique hysteresis curve, where shape recovery takes significantly longer time than compression, thus prompt and full stress relief is enabled at the side of the seat portion 102 opposite to the sitting person pivoting direction, as is specifically seen in FIG. 11.

It is a particular feature of an embodiment of the present invention that tilting mechanism 104 is therapeutically beneficial, since upon movement of the sitting person and thus changing the center of gravity, the upper plate 106 is momentarily pivoted relative to the bottom support plate 110, thus foam layer 108 is compressed at first side of seat cushion 100 and released from the second side of seat cushion 100. Due to the viscosity of memory foam and delayed shape restoration, pressure relief is momentarily created at one side of the body of the sitting person. Opposite movement of the sitting person creates pressure relief on the other side of the body. This effect of the tilting mechanism 104 serves as a self-propelled massage device, providing for proper blood and lymph circulation in the body of the sitting person. It is appreciated that additional advantage of the tilting mechanism 104 is that the sitting person constantly attempts to compensate for the created pressure changes in order to preserve stability, thus providing for muscle training.

It will be appreciated by persons skilled in the art that the present invention is not limited by what has been particularly shown and described hereinabove. Rather the scope of the present invention includes both combinations and subcombinations of various features described hereinabove as well as variations and modifications thereof which are not in the prior art.

The invention claimed is:

1. A seat cushion provided for supporting a sitting person, comprising:

a seat portion made of a resilient material and having an upwardly facing surface and a downwardly facing surface;

a plurality of mutually spaced inclined grooves formed in said seat portion, and arranged along longitudinal axes; wherein said inclined grooves extend along at least a portion of the distance between said upwardly facing surface and said downwardly facing surface; and wherein said longitudinal axes extend at an angle with respect to at least one of said upwardly facing surface and said downwardly facing surface.

2. The seat cushion according to claim 1, and wherein said inclined grooves extend upwardly from said downwardly facing surface.

3. The seat cushion according to claim 1, and wherein said inclined grooves extend downwardly from said upwardly facing surface.

4. The seat cushion according to claim 1, and wherein said inclined grooves have a circular cross-section.

5. The seat cushion according to claim 1, and wherein said plurality of inclined grooves extends in parallel to each other.

6. The seat cushion according to claim 1, and wherein said plurality of inclined grooves extends at an angle relative to said downwardly facing surface.

7. The seat cushion according to claim 5, and wherein said plurality of inclined grooves extends at an acute angle relative to said downwardly facing surface.

8. The seat cushion according to claim 5, and wherein said plurality of inclined grooves extends at an obtuse angle relative to said downwardly facing surface.

9. The seat cushion according to claim 1, and wherein said plurality of inclined grooves extends from said downwardly facing surface to said upwardly facing surface.

10. The seat cushion according to claim 1, and wherein said plurality of inclined grooves enables upon application of pressure on said seat portion, pressure equalization across the volume of said seat portion.

11. The seat cushion according to claim 1, and wherein upon application of pressure on said seat portion, a stress exerted on a body portion of said sitting person remains substantially constant notwithstanding the extent of strain formed within said seat portion.

12. The seat cushion according to claim 1, and wherein said seat portion is made of high resiliency foam.

13. A seat cushion provided for supporting a sitting person, comprising:

a seat portion;

and a tilting mechanism coupled thereto and having a swivel point adapted to provide fluctuations of pressure exerted on a body portion of said sitting person upon application of pressure outside of a central portion of said seat portion and wherein said tilting mechanism includes a first rigid plate, a second rigid plate and an intermediate substrate disposed between said first and second rigid plates.

14. The seat cushion according to claim 13, and wherein said intermediate substrate is made of memory foam.

15. The seat cushion according to claim 13, and wherein said first plate, said second plate and said intermediate substrate are attached to each other.

16. The seat cushion according to claim 13, and wherein said swivel point is a protrusion formed on said first rigid plate and engages said second rigid plate.

17. The seat cushion according to claim 1 and also comprising a tilting mechanism.

18. The seat cushion according to claim 1, and wherein said grooves are formed during a molding process of said seat portion.

19. The seat cushion according to claim 1, and wherein said grooves are drilled within said seat portion.

* * * * *